United States Patent [19]

Fresard

[11] 4,127,077

[45] Nov. 28, 1978

[54] PORTABLE SEWING MACHINE

[75] Inventor: Marcel Fresard, Petit-Lancy, Switzerland

[73] Assignee: Mefina S.A., Fribourg, Switzerland

[21] Appl. No.: 807,722

[22] Filed: Jun. 17, 1977

[30] Foreign Application Priority Data

| | | | |
|---|---|---|---|
| Jun. 30, 1976 | [CH] | Switzerland | 8340/76 |
| Feb. 8, 1977 | [CH] | Switzerland | 1474/77 |
| Apr. 15, 1977 | [CH] | Switzerland | 4673/77 |
| Apr. 15, 1977 | [CH] | Switzerland | 4674/77 |

[51] Int. Cl.[2] ..... D05B 75/06

[52] U.S. Cl. ..... 112/258; 312/282; 16/171

[58] Field of Search ..... 112/258, 260, 217.1; 312/208, 282; 16/171, 173, 174, 149, 180, 181, 182, 183, DIG. 13

[56] References Cited

U.S. PATENT DOCUMENTS

| | | | |
|---|---|---|---|
| 2,958,304 | 11/1960 | Arbib | 112/260 |
| 2,971,485 | 2/1961 | Hamlett | 112/258 |
| 3,471,874 | 10/1969 | Dixon | 16/171 X |
| 3,561,383 | 2/1971 | Fresard | 112/217.1 |
| 3,680,927 | 8/1972 | Neureuther | 16/171 X |
| 3,908,227 | 9/1975 | Cain | 16/182 X |

*Primary Examiner*—George H. Krizmanich
*Attorney, Agent, or Firm*—Emory L. Groff, Jr.

[57] ABSTRACT

A portable sewing machine comprises a frame formed of a base, a column, an upper arm, a head and flaps detachably hinged to edges of the upper face of the base. The machine stands on a part of the base adjacent the column and the base has an overhanging free end part enabling the sewing of tubular articles when the flaps are removed.

14 Claims, 16 Drawing Figures

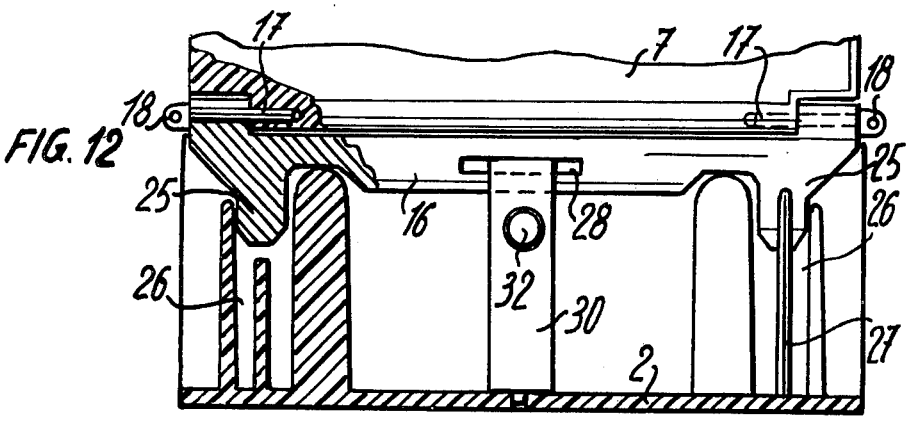
FIG. 12
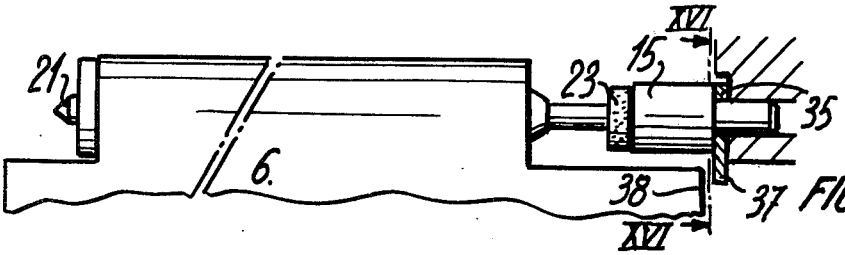
FIG. 14
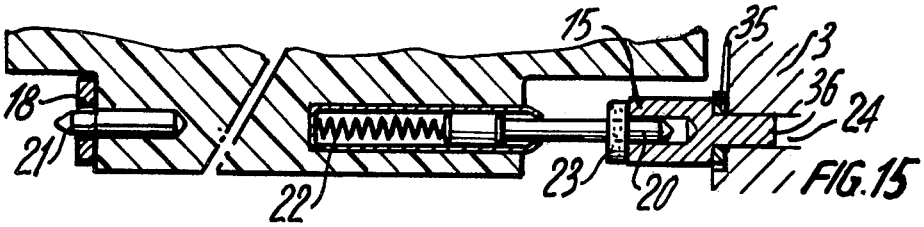
FIG. 15
FIG. 16
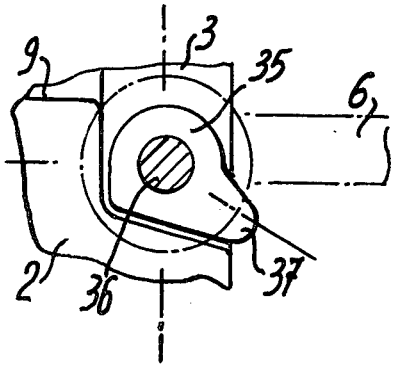
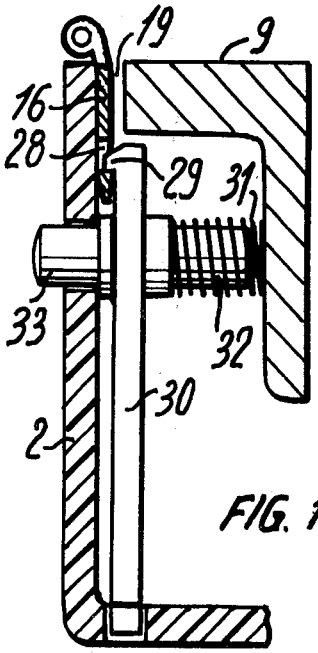
FIG. 13

PORTABLE SEWING MACHINE

The invention concerns portable sewing machines of the type comprising a frame formed of a base, a column, an upper arm, a head and flaps hinged to the edges of the upper face of the base.

Unlike the more expensive type of sewing machine having a so-called lower free arm, known sewing machines equipped with flaps hinged to the upper edge of the base, forming the working surface, are not suitable for the sewing of generally tubular articles.

An aim of the invention is to enable the sewing of some generally tubular articles on such a portable sewing machine with a plane working surface and of simple construction.

According to the invention, a sewing machine of the aforesaid type is characterized in that the flaps are detachably hinged to the edges of the upper face of the base, and a part of the base adjacent its free end is in overhanging relationship to the outer part of the base adjacent the column.

The accompanying drawings show, schematically and by way of example, several embodiments of sewing machines according to the invention. In the drawings:

FIG. 12 is a cross-section, to a greater scale, along line XII—XII of FIG. 11;

FIG. 13 is a cross-section, to a greater scale, along line XIII—XIII of FIG. 11;

FIG. 14 is a view, to a greater scale, of part of a side flap of the machine of FIG. 11, in the closed position as in FIG. 4;

FIG. 15 is a cross-section to a greater scale, along line XV—XV of FIG. 11; and

FIG. 16 is a cross-section along line XVI—XVI of FIG. 14.

Figure 1:
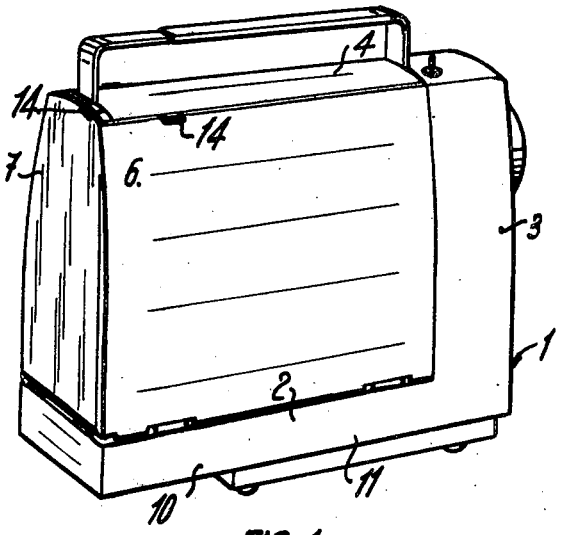
FIG. 1 is a perspective view of a first embodiment of machine with its flaps in a closed position.
Figure 2:
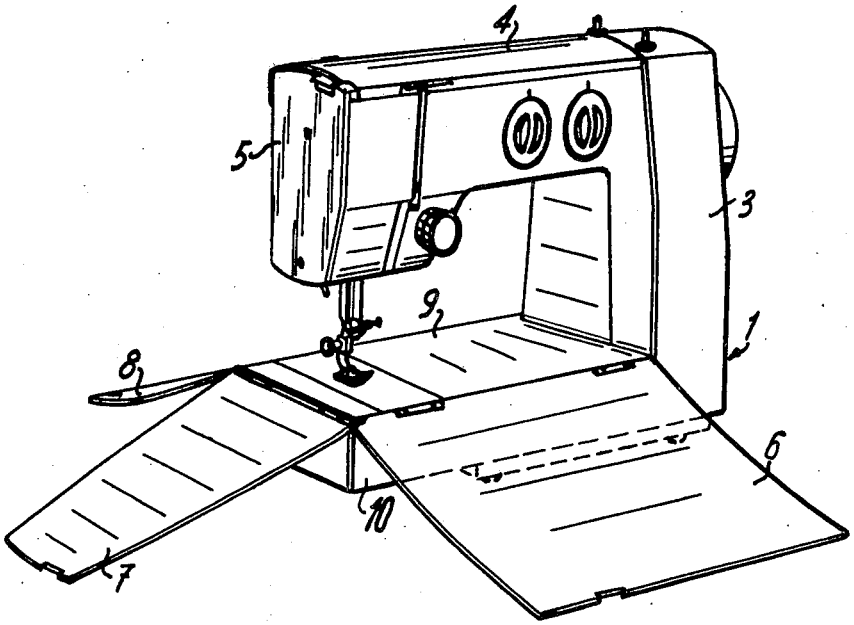
FIG. 2 is a perspective view of this machine with its flaps folded down in a working position.
Figure 3:
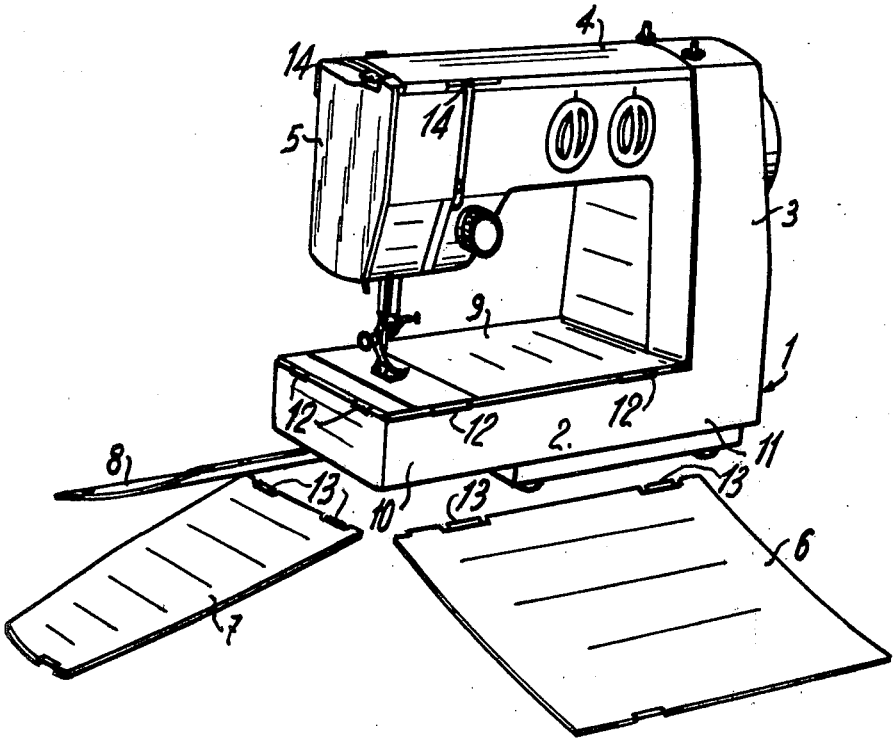
FIG. 3 is a perspective view of this machine with its flaps detached from the base for the sewing of tubular articles.

The sewing machine shown in FIGS. 1 to 3 comprises a frame 1 formed of a base 2, a column 3, an upper arm 4, a head 5 overlying the base 2, and flaps 6, 7 and 8 hinged to the edges of the flat upper face of the base 2 forming the working surface.

A part 10 of the base 2, adjacent the free end thereof, is in overhanging relationship to the part 11 of the base adjacent the column 3 and on which the machine stands.

Pairs of U-shaped fasteners 12 are fixed to the base 2 along the edges of its upper face 9, the bases of the U's of these fasteners 12 forming ridges protruding in a manner to serve as pivoting axles for the lower edges of the flaps 6, 7, 8. The inner face of each flap has, along its lower edge (looking at FIG. 1), grooved tabs 13 adapted to engage on the base of the U of the corresponding fastener 12 when the flaps 6, 7, 8 are lifted up in the closed position of the machine and locked in this position by hooks 14 (FIG. 1), or are lowered for sewing (FIG. 2).

When the flaps are detached from the base of the U of the fasteners 12 (FIG. 3), a tubular article to be sewn may be engaged on the overhanging part 10 of the base 2, by its free end.

Numerous variations of this first embodiment may be envisaged.

The fasteners 12 fixed to the base 2 of the machine, as well as the tabs 15 of flaps 6, 7, 8 could for example be replaced by any other hinging device enabling separation of the flaps 6, 7, 8 from the base 2 of the machine.

When some of the flaps are curved, as shown for flaps 6 and 8, they may be provided with members for reversibly securing them to the base 2, enabling use at choice of their concave face of their convex face as delivery ramp for fabric to be sewn.

The sewing machine shown in FIGS. 4 to 10 comprises, as before, a frame 1 formed of a base 2, a column 3, an upper arm 4, a head 5, and flaps 6, 7, 8 hinged to the edges of the upper face 9 of base 2 forming the working surface.

A socket 15 is mounted in a bore 24 of the column 3 along each of the lateral edges of the upper face 9 and parallel to these edges. A plate 16 is hinged to the lower edge of the front flap 7 by means of two pivots 17 each having a protruding head provided with an eyelet 18. This plate 16 can be fitted in a slot 19 in the front edge of the upper face 9 of the base 2 to place the eyelets 18 adjacent the ends of the lateral edges of the upper face 9.

Figure 4:
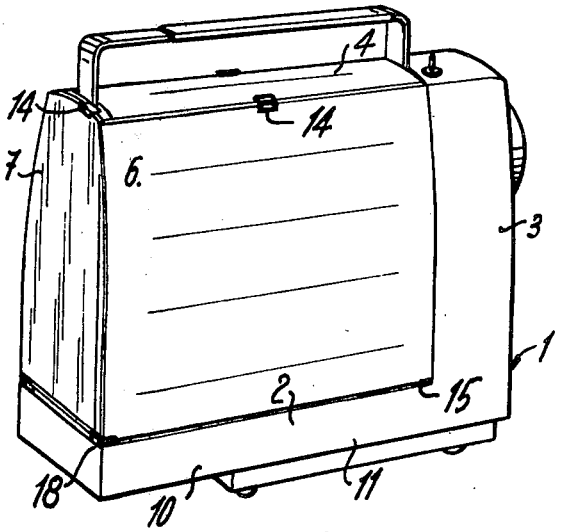
FIGS. 4 to 6 are views similar to FIGS. 1 to 3, of a second embodiment.
Figure 5:
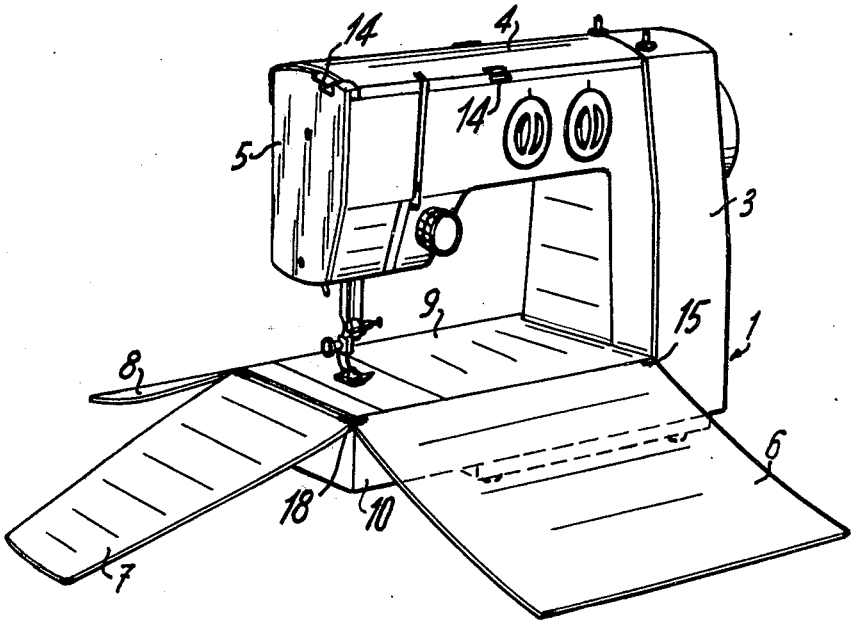
Figure 6:
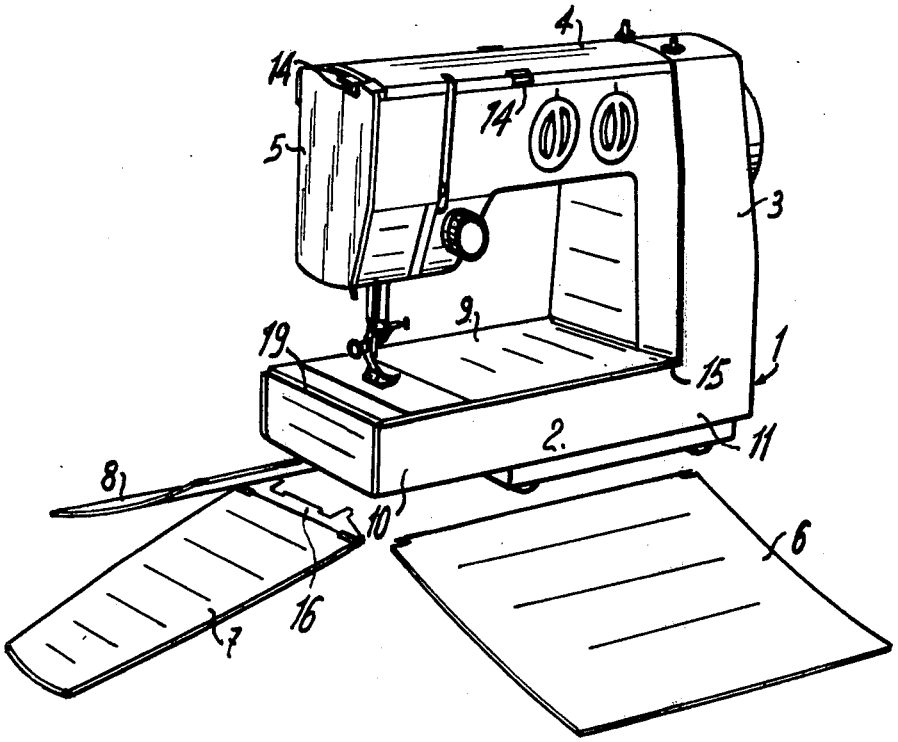
Figure 9:
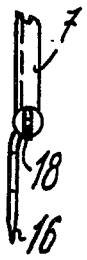
FIG. 9 is a side view from the left of FIG. 7.
Figure 7:
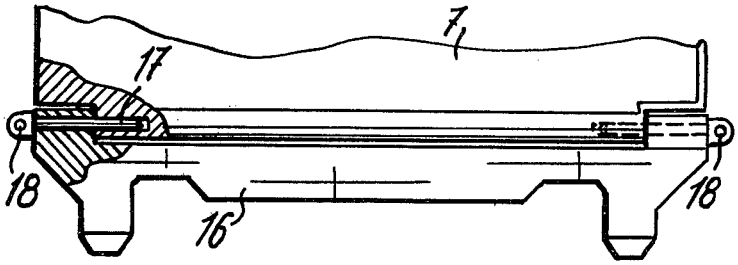
FIGS. 7 and 8 are plan views, partly cut-away and to a greater scale, of parts of two flaps of the second embodiment.
Figure 8:
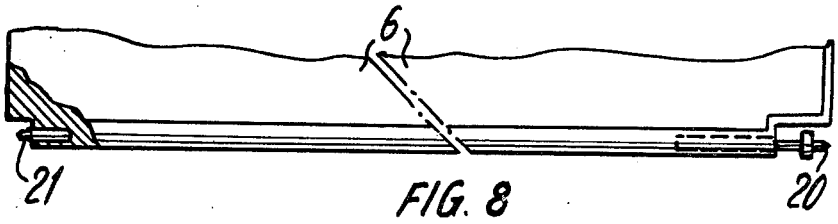
Figure 10:
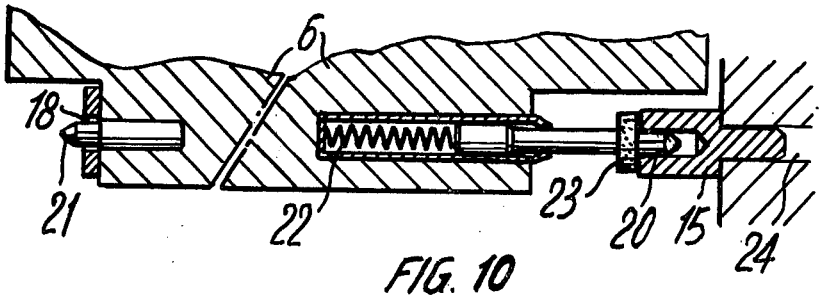
FIG. 10 is a longitudinal cross-section, to a greater scale, of the flap of FIG. 8, showing one end fitted to the machine.

The lateral flaps 6, 8 are provided, at the ends their lower edge (looking at FIG. 4), with pivots 20, 21, one of which (20) is retractable against the action of a spring 22. This pivot 20 also has a keeper 23. As shown in FIGS. 4, 5 and 10, the lateral flaps 6, 8 are removably mounted on the machine by engagement of the pivot 20 in a socket 15 and of the pivot 21 in an eyelet 18 at the respective sides of the upper face 9 of the base 2.

The flaps 6 and 8 may be mounted interchangeably on the two lateral edges of the upper face 9, and are reversible. As they are curved from their upper edge to the lower edge one may, in the folded-down working position (FIG. 5), either use their concave face on their convex face as delivery ramp for fabric to be sewn.

When the front flap 7 with the plate 16 carrying the eyelets 18 is removed from the slot 19, for the sewing of articles of tubular shape (FIG. 6), the overhanging part 10 of base 2 is exempt from any member for securing the flaps 6–8.

Numerous variations of the second embodiment may be envisaged.

The sockets 15 mounted in the bores 24 of the column 3 could, for example, be dispensed with and a pivot 20, 21 of each of the flaps 6, 8 could simply be removably engaged in a bearing formed by one of the bores 24.

The flaps 6, 7, 8 may as known be of metal or plastics material. Preferably, however, they are made of a transparent tinted or non-tinted plastics material.

Figure 11:
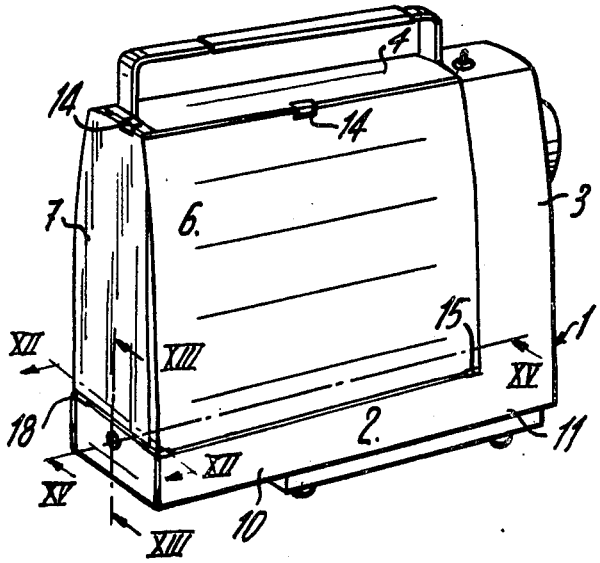
FIG. 11 is a perspective view of a varied form of the second embodiment of machine, with its flaps closed.

According to a variation of the second embodiment, the machine comprises a device (28–33, FIGS. 11–13) for locking the plate 16 in base 2.

As shown in FIG. 12, the plate 16 has two tabs 25 extending in grooves 26 in the base 2 and under a retaining bar 27. The plate 16 also has a central slot 28 for receiving a catch 29 carried by the upper end of a lever 30 mounted in the base 2 and biased by a spring 31 (FIG. 13) mounted on an extension of a push-button 33 enabling unlocking of the plate 16.

It is hence possible to detach the front flap 7 from the base 2 of the machine by pressing on the push-button 33 to displace the locking lever 30 against the action of spring 31.

In another variation of the second embodiment, shown in FIGS. 14 to 16, at least one of the sockets 15 mounted in the bores 24 of column 3 is provided with an abutment 35 preventing movement of the corresponding lateral flap (e.g. 6) towards the column 3 when the flap is in its working position shown in FIG. 5.

The abutment 35 is an annular piece mounted on an extension 36 of the socket 15 penetrating in the bore 24 of column 3. Each abutment 35 has a flat bearing on a shoulder formed in the corresponding lateral edge of the upper face 9 of the base 2 and extended by a projection 37 projecting in the proximity of the edge 38 of the flap 6 or 8 adjacent the column 3, when the flap is in the working position shown in FIGS. 5 and 14.

Hence, only when the flaps 6, 8 are brought substantially parallel to the upper face 9 of the base 2 (see FIG. 16) can they be moved towards the column 3 to disengage the pivot 21 from eyelet 18 and then pivot 20 from socket 15. Consequently, when the flap 6 (or 8) is in the working position shown in FIGS. 5 and 14, it cannot be inadvertently detached from the lateral edge of the upper face 9.

One may, of course, simply provide only the socket 15 of the front lateral edge of the upper face 9 with an annular abutment 35, as the flap 8 hinged to the rear lateral edge of the upper face 2 is less likely to be inadvertently detached during sewing when it is in the working position shown in FIG. 5.

I claim:

1. In a portable sewing machine comprising a frame formed of a base, a column, an upper arm, a head and flaps hinged to the front and lateral edges of the upper face of the base, the improvement comprising hinge means detachably hinging said flaps to said edges of the upper face of the base, a part of the base adjacent its free end being in overhanging relationship to the other part of said base adjacent said column to provide a free arm when said flaps are detached, a bearing mounted at each of the lateral edges of the upper face of said base parallel to said edges and adjacent said column, an eyelet removably mounted at each of the lateral edges of the upper face of the base adjacent its front end, and two lateral flaps each having pivots fixed at the ends of a lower edge thereof, said pivots being removably engaged in a related bearing and eyelet mounted at one of the lateral edges of the upper face of the base.

2. A sewing machine according to claim 1, comprising flaps which are curved from the pivoted edge thereof to the free edge, and means for reversibly pivotally securing the curved flaps to the base to enable the use at choice of their concave face or their convex face as delivery ramp for fabric to be sewn. column, an eyelet removably mounted on each of the lateral edges of the upper face of the base adjacent its front end, and two lateral flaps each having pivots fixed at the ends of a lower edge thereof, said pivots being removably engaged in the bearing and eyelet mounted on one of the lateral edges of the upper face of the base.

3. A sewing machine according to claim 1, in which each bearing comprises a bore in the column in extension of a lateral edge of the upper face of the base.

4. A sewing machine according to claim 3, comprising a socket mounted in each said bore of the column.

5. A sewing machine according to claim 1, in which at least one of the pivots of each lateral flap is retractable, said lateral flaps being interchangeably mounted on the two longitudinal edges of the upper face of the base.

6. A sewing machine according to claim 1, in which the eyelets are formed at the ends of hinge pivots of a front flap pivotally mounted on a front edge of the upper face of the base.

7. A sewing machine according to claim 6, in which said pivots provided with the eyelets are fixed on a support piece removably mounted on the end of the base.

8. A sewing machine according to claim 7, in which said support piece is a plate which engages in a slot in the front edge of the upper face of the base.

9. A sewing machine according to claim 1, in which at least one of the flaps is of transparent plastics material.

10. A sewing machine according to claim 8, comprising a device for locking said plate in the base.

11. A sewing machine according to claim 10, in which said locking device comprises a lever mounted in the base, the lever having a catch which can engage in a slot in the plate.

12. A sewing machine according to claim 11, comprising a push-button for moving the lever to disengage the catch from the slot of the plate against the action of a biasing spring.

13. A sewing machine according to claim 4, in which at least one of said sockets has an abutment disposed adjacent an edge of a corresponding flap when the flap is in a folded-down working position to prevent inadvertent displacement of the flap towards the column and detachment of its other pivot from the corresponding eyelet.

14. A sewing machine according to claim 13, in which said abutment comprises an annular piece having a lateral projecting part.

* * * * *